US012291958B2

(12) United States Patent
Jones et al.

(10) Patent No.: US 12,291,958 B2
(45) Date of Patent: May 6, 2025

(54) PRESSURE MEASUREMENT MITIGATION

(71) Applicant: Halliburton Energy Services, Inc., Houston, TX (US)

(72) Inventors: Christopher Michael Jones, Katy, TX (US); Anthony Herman Van Zuilekom, Houston, TX (US); Mehdi Alipour Kallehbasti, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 30 days.

(21) Appl. No.: 18/330,134

(22) Filed: Jun. 6, 2023

(65) Prior Publication Data

US 2023/0313674 A1 Oct. 5, 2023

Related U.S. Application Data

(62) Division of application No. 17/833,201, filed on Jun. 6, 2022, now Pat. No. 11,686,193, which is a division (Continued)

(51) Int. Cl.
*E21B 47/06* (2012.01)
*E21B 49/00* (2006.01)

(Continued)

(52) U.S. Cl.
CPC ..... *E21B 47/06* (2013.01); *E21B 49/008* (2013.01); *E21B 49/087* (2013.01); *E21B 49/10* (2013.01)

(58) Field of Classification Search
CPC ..... E21B 47/06; E21B 49/008; E21B 49/087; E21B 49/0875; E21B 49/10
See application file for complete search history.

(56) References Cited

U.S. PATENT DOCUMENTS 5,602,334 A 2/1997 Proett et al.
6,230,557 B1 5/2001 Ciglenec et al.

(Continued)

FOREIGN PATENT DOCUMENTS

WO WO0208570 A1 1/2002
WO WO0214652 A1 2/2002

(Continued)

OTHER PUBLICATIONS

PCT Application No. PCT/US2019/034979, International Preliminary Report on Patentability, mailed Dec. 9, 2021, 7 pages.

(Continued)

*Primary Examiner* — Jennifer H Gay
(74) *Attorney, Agent, or Firm* — DeLizio, Peacock, Lewin & Guerra LLP

(57) ABSTRACT

An apparatus comprises a formation tester tool to be positioned in a borehole within a formation, wherein the formation tester tool comprises a pressure sensor and a pad that is radially extendable with respect to an axis of the formation tester tool, and wherein the pressure sensor is inside the pad. The apparatus comprises a first radially extendable inner packer that is axially above the pad with respect to the axis of the formation tester tool and a second radially extendable outer packer that is axially above the first radially extendable inner packer. The apparatus comprises a third radially extendable inner packer that is axially below the pad with respect to the axis of the formation tester tool and a fourth radially extendable outer packer that is axially below the third radially extendable inner packer.

21 Claims, 9 Drawing Sheets

Related U.S. Application Data of application No. 16/428,323, filed on May 31, 2019, now Pat. No. 11,359,480.

(51) Int. Cl.
*E21B 49/08* (2006.01)
*E21B 49/10* (2006.01)

(56) References Cited

U.S. PATENT DOCUMENTS

| | | | | |
|---|---|---|---|---|
| 6,301,959 | B1 | 10/2001 | Hrametz et al. | |
| 6,585,045 | B2 | 7/2003 | Lee et al. | |
| 6,923,052 | B2 | 8/2005 | Krueger et al. | |
| 6,932,167 | B2 | 8/2005 | Proett et al. | |
| 7,178,392 | B2 | 2/2007 | Dhruva et al. | |
| 7,243,537 | B2 | 7/2007 | Proett et al. | |
| 7,260,985 | B2 | 8/2007 | Gilbert et al. | |
| 7,558,716 | B2 | 7/2009 | Hammond | |
| 7,584,655 | B2 | 9/2009 | van Zuilekom et al. | |
| 7,603,897 | B2 | 10/2009 | Gilbert et al. | |
| 7,966,875 | B2 | 6/2011 | Proett et al. | |
| 8,015,869 | B2 | 9/2011 | Nold III V, et al. | |
| 9,085,964 | B2 | 7/2015 | Sherrill et al. | |
| 9,581,019 | B2 | 2/2017 | Chang et al. | |
| 9,638,034 | B2 | 5/2017 | Chen et al. | |
| 9,714,570 | B2 | 7/2017 | Gisolf | |
| 9,945,224 | B2 | 4/2018 | Proett et al. | |
| 10,156,138 | B2 | 12/2018 | Irani et al. | |
| 11,359,480 | B2 | 6/2022 | Jones et al. | |
| 11,655,705 | B2 * | 5/2023 | Jones | E21B 49/008 166/250.01 |
| 11,686,193 | B2 * | 6/2023 | Jones | E21B 49/087 166/250.01 |
| 2002/0046835 | A1 | 4/2002 | Lee et al. | |
| 2009/0250214 | A1 | 10/2009 | Simpson et al. | |
| 2010/0050762 | A1 | 3/2010 | Nold, III et al. | |
| 2010/0286918 | A1 | 11/2010 | Moos et al. | |
| 2010/0319912 | A1 | 12/2010 | Pop et al. | |
| 2011/0162836 | A1 | 7/2011 | Church | |
| 2012/0253679 | A1 | 10/2012 | Chang et al. | |
| 2015/0007985 | A1 | 1/2015 | Gisolf | |
| 2015/0337656 | A1 | 11/2015 | Irani et al. | |
| 2017/0022809 | A1 | 1/2017 | Garcia et al. | |
| 2017/0175524 | A1 | 6/2017 | Dumont et al. | |
| 2018/0003049 | A1 | 1/2018 | Gisolf et al. | |
| 2020/0240265 | A1 | 7/2020 | Machocki et al. | |
| 2020/0378238 | A1 | 12/2020 | Jones et al. | |
| 2020/0400017 | A1 | 12/2020 | Olapade et al. | |
| 2022/0298913 | A1 | 9/2022 | Jones et al. | |
| 2022/0298914 | A1 | 9/2022 | Jones et al. | |
| 2023/0313674 | A1 * | 10/2023 | Jones | E21B 49/008 166/250.01 |

FOREIGN PATENT DOCUMENTS

| | | | |
|---|---|---|---|
| WO | WO2014107146 | A1 | 7/2014 |
| WO | WO2020242497 | A1 | 12/2020 |

OTHER PUBLICATIONS

PCT Application Serial No. PCT/US2019/034979, International Search Report, mailed Feb. 28, 2020, 4 pages.
PCT Application Serial No. PCT/US2019/034979, International Written Opinion, mailed Feb. 28, 2020, 6 pages.
U.S. Appl. No. 16/428,323, Final Office Action mailed May 14, 2021, 14 pages.
U.S. Appl. No. 16/428,323, Non-Final Office Action mailed Sep. 23, 2021, 8 pages.
U.S. Appl. No. 16/428,323 Restriction Requirement, mailed Oct. 22, 2020, 6 pages.
U.S. Appl. No. 17/833,503 Office Action, Nov. 22, 2022, 14 pages.
U.S. Appl. No. 17/833,201 Office Action, Nov. 9, 2022, 13 pages.

* cited by examiner

PRESSURE MEASUREMENT MITIGATION

BACKGROUND

The disclosure generally relates to the field of measurement, and more particularly to pressure measurement.

Various well operations, such as stimulation operations and drilling operations, include activities to measure formation pressure of a fluid within the formation from within a borehole. The formation pressure can be measured by establishing a sealed connection volume between a pressure sensor located in the wellbore and the formation. During measurement, the pressure sensor can measure the pressure of fluids in the sealed connection volume which are in hydraulic communication with the fluids in the formation. The pressure value measured by the sensor can be processed by a downhole tool or transmitted to a device outside of the borehole.

BRIEF DESCRIPTION OF THE DRAWINGS

Aspects of the disclosure may be better understood by referencing the accompanying drawings.

DESCRIPTION OF EMBODIMENTS

Figure 1:
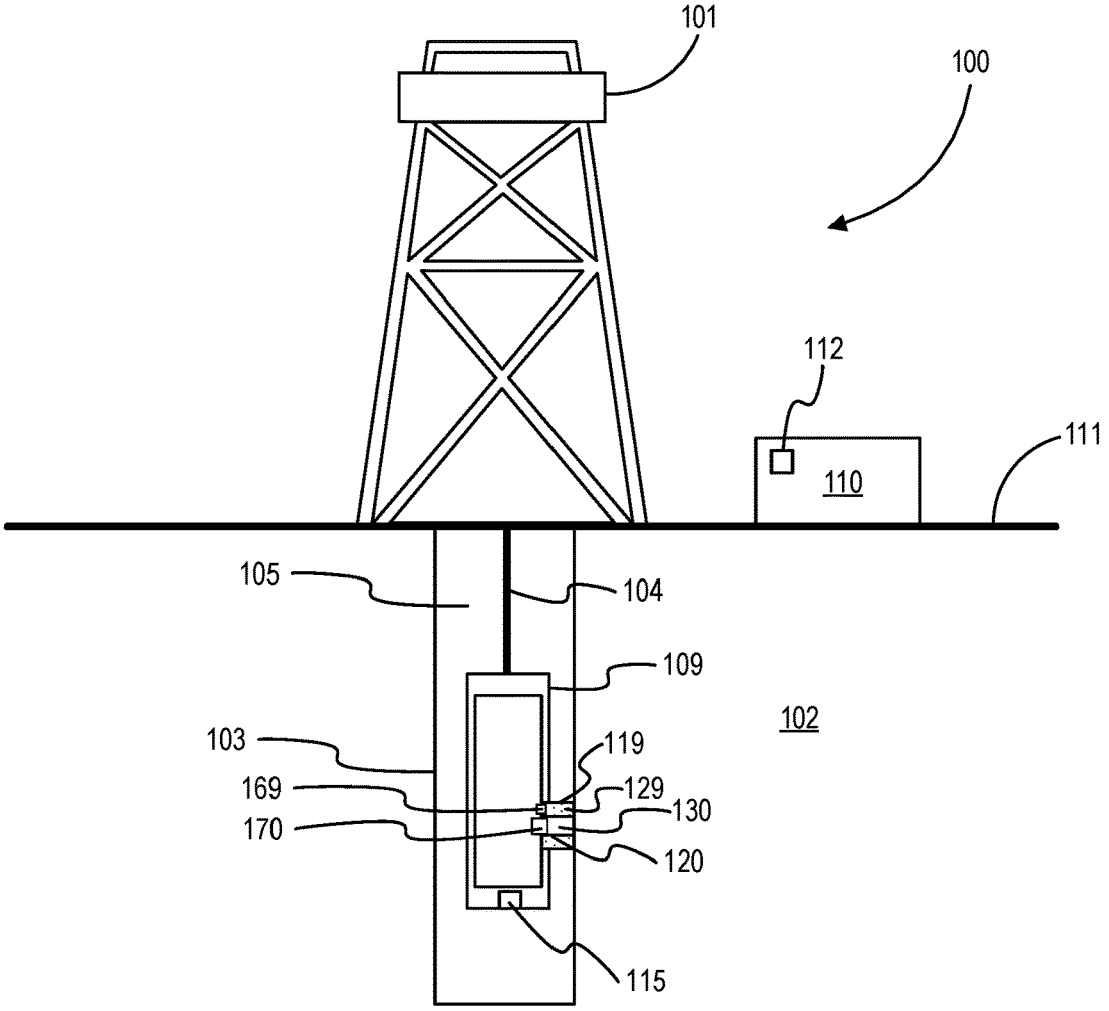
FIG. 1 is an elevation view of an onshore wireline system operating a formation tester tool that includes a pressure measurement system having pads.

The description that follows includes example systems, methods, techniques, and program flows that embody elements of the disclosure. However, it is understood that this disclosure can be practiced without these specific details. For instance, this disclosure refers to pressure measurements acquired during or after a buildup or drawdown operation. Aspects of this disclosure can instead be applied to pressure measurements acquired during or after other operations, such as during or after a fluid injection operation, foaming operation, or drilling operation. In other cases, well-known instruction instances, protocols, structures, and techniques have not been shown in detail in order not to obfuscate the description.

Various embodiments can relate to a pressure measurement method and related measurement devices or systems for measuring a pressure. The pressure measurement method can provide increased accuracy when faced with physical phenomena such as supercharging, wherein a measured formation pressure is artificially altered by a well operation and the measured result may not equal to a true formation pressure. For example, supercharging can occur from active influx of fluid from the wellbore into the formation. The pressure measurement method can include acquiring a series of pressure measurements using a pressure sensor and detecting/determining a pressure measurement pattern over the series of pressure measurements to control a wellbore fluid influx guarded in order to mitigate the effects of supercharging or other artificial influences on formation pressure. By measuring pressure changes over time using a pressure sensor in hydraulic communication with a formation and a guard probe also in hydraulic communication with the formation which isolates the first guard from wellbore hydrostatic pressure, a pressure measurement system or device can overcome the influences that well operations can have on formation pressures. As used in this application, a probe can be a pad, a packer, or any portion of a tool that can form a sealed volume with the borehole wall and isolate fluid inside of the probe from fluids outside of the probe.

In some embodiments, the pressure measurement method can include forming a sealed connection volume between a formation and the pressure sensor in the borehole. The method can include raising the pressure measured by the pressure sensor by performing a buildup operation and then lowering the pressure measured by the pressure sensor during a drawdown operation. The pressure sensor can then acquire a pressure measurement from fluids in the sealed connection volume. The pressure of a second volume formed by the guard probe around the sealed connection of the first volume can then be lowered relative to the pressure measurement to an equilibrium drawdown as measured by a second pressure gage in communication with the second volume. The pressure sensor can then acquire a series of pressure measurements over multiple buildup/drawdown operations, during which the pressure of the volume around the sealed connection volume is lowered during or after some or all of the operations.

For example, the pressure sensor can acquire a second pressure measurement after the pressure of the volume around the sealed connection volume is lowered. A pressure measurement system or device can perform another buildup/drawdown operation and then reduce the pressure of the volume around the sealed connection volume a second time. The pressure sensor can acquire a third measurement after the second pressure reduction of the volume around the sealed connection volume. Based on at least a portion of the series of pressure measurements, the pressure measurement system or device can determine whether a measurement pattern shows a trend to a formation pressure value. For example, based on a first, second, and third pressure measurement, the pressure measurement system or device can determine that a measurement pattern shows a trend to a formation pressure value.

If the device or system determines that the measurement pattern shows a trend to a stable formation pressure measurement value, the device or system can set that formation pressure value as an actual formation pressure. Otherwise, the device or system can acquire additional pressure measurements using the pressure sensor after additional pressure reductions in the volume around the pressure sensor to determine if an updated measurement pattern shows a trend to a formation pressure value. In addition, the device or system can predict a formation property such as the amount of hydrocarbon in place, the type(s) of hydrocarbon in place, and/or a formation permeability based on the formation pressure value. By increasing the accuracy of a formation pressure measurement, the pressure measurement methods and related devices and systems disclosed herein can also increase the accuracy of volume predictions for formation fluid in a reservoir and other formation property predictions.

Example Wireline Systems

FIG. 1 is an elevation view of an onshore wireline system operating a formation tester tool that includes a pressure measurement system having pads. A wireline system 100 is operated at a rig 101 located at a surface 111 and positioned above a borehole 103 within a formation 102. The wireline system 100 can include a wireline 104 supporting a formation tester tool 109 that includes an outer pad 119 and an inner pad 120. Both the outer pad 119 and the inner pad 120 can extract and isolate a formation fluid sample from their respective radially outward ends. A surface system 110 located at the surface 111 can include a processor 112 and memory device and can communicate with components of the formation tester tool 109 such as the outer pad 119 and the inner pad 120.

During the pressure measurement operation, the inner pad 120 can radially extend with respect to the axis of the formation tester tool 109 to form an inner sealed connection volume 130 with a wall of the borehole 103. Fluids in the inner sealed connection volume 130 can be isolated from fluids flowing in the exposed borehole region 105 or from fluids in an outer sealed connection volume 129. Similarly, the outer pad 119 can radially extend with respect to the axis of the formation tester tool 109 to form the outer sealed connection volume 129 with the wall of the borehole 103, wherein fluids in the outer sealed connection volume 129 can be isolated from fluids flowing in the exposed borehole region 105 or from fluids in the inner sealed connection volume 130. As it is to be understood in this disclosure, a sealed connection volume refers to a volume having a sealed connection between a borehole wall and a pad or other enclosed space of the formation tester tool 109. The second, outer pad may extend with the first pad, or independent of the first pad being either prior to or after the first pad.

During a pressure measurement operation, the wireline system 100 can perform a drawdown operation and a buildup operation. The wireline tool can induce a drawdown by operation of a mechanical pump moving a volume of fluid from through a hydraulically sealed pad. Buildup occurs as the drawdown operation is stopped and the pressure at the measurement point rebounds to the sandface pressure, wherein the sandface pressure can be the pressure at the point that the pad contacts the formation. The sandface pressure may be different from the formation pressure due to effects such as supercharging. As described further below, the wireline system 100 can perform repeated drawdown/buildup operations. In some embodiments, the wireline system can determine a formation pressure based on the measured sandface pressure.

A pressure sensor 170 of the inner pad 120 can acquire a first pressure measurement from fluids within the inner sealed connection volume 130. The outer pad 119 can act as a pressure control system and reduce the pressure around the inner pad 120 during a first depressurization interval to a pressure lower than at least one of the borehole pressure and the first pressure measurement by drawing fluid into the formation tester tool 109 through the outer sealed connection volume 129, wherein the pressure in the outer sealed connection volume 129 can be measured by a pressure sensor 169. The drawdown on the outer volume may be operated as a constant rate drawdown or a constant pressure drawdown. The wireline system 100 can acquire a second pressure measurement using the pressure sensor 170 during or after the depressurization interval. The wireline system 100 can then perform at least one additional iteration to acquire one or more pressure measurements using the pressure sensor 170, wherein the iteration can include a buildup operation, a drawdown operation, and/or an operation to reduce the pressure around the sealed connection volume 130 during another depressurization interval. As described further below in the description corresponding with the flowchart 800 of FIG. 8, the system can perform repeated iterations of these operations to determine a measurement pattern for predicting one or more formation properties based on a trend of the measurement pattern and/or the pressure measurements used to generate the measurement pattern.

In some embodiments, pressure measurements from the formation tester tool 109 are transmitted to the surface 111 via the wireline 104. In some embodiments, the results provided from a processor 115 in the formation tester tool 109 using the operations disclosed below for flowchart 800 of FIG. 8 can be transmitted via the wireline 104. Alternatively, or in addition, pressure measurements and/or the results based on the pressure measurements can be communicated via fluid pulses traveling through fluids in the borehole 103 or electromagnetic signals projected toward the surface 111. Once at the surface 111, the pressure measurements and/or results based on the pressure measurements can be communicated to the processor 112 in the surface system 110. In addition, the wireline 104 can include a fluid tube through which fluid can be passed to the surface.

Figure 2:
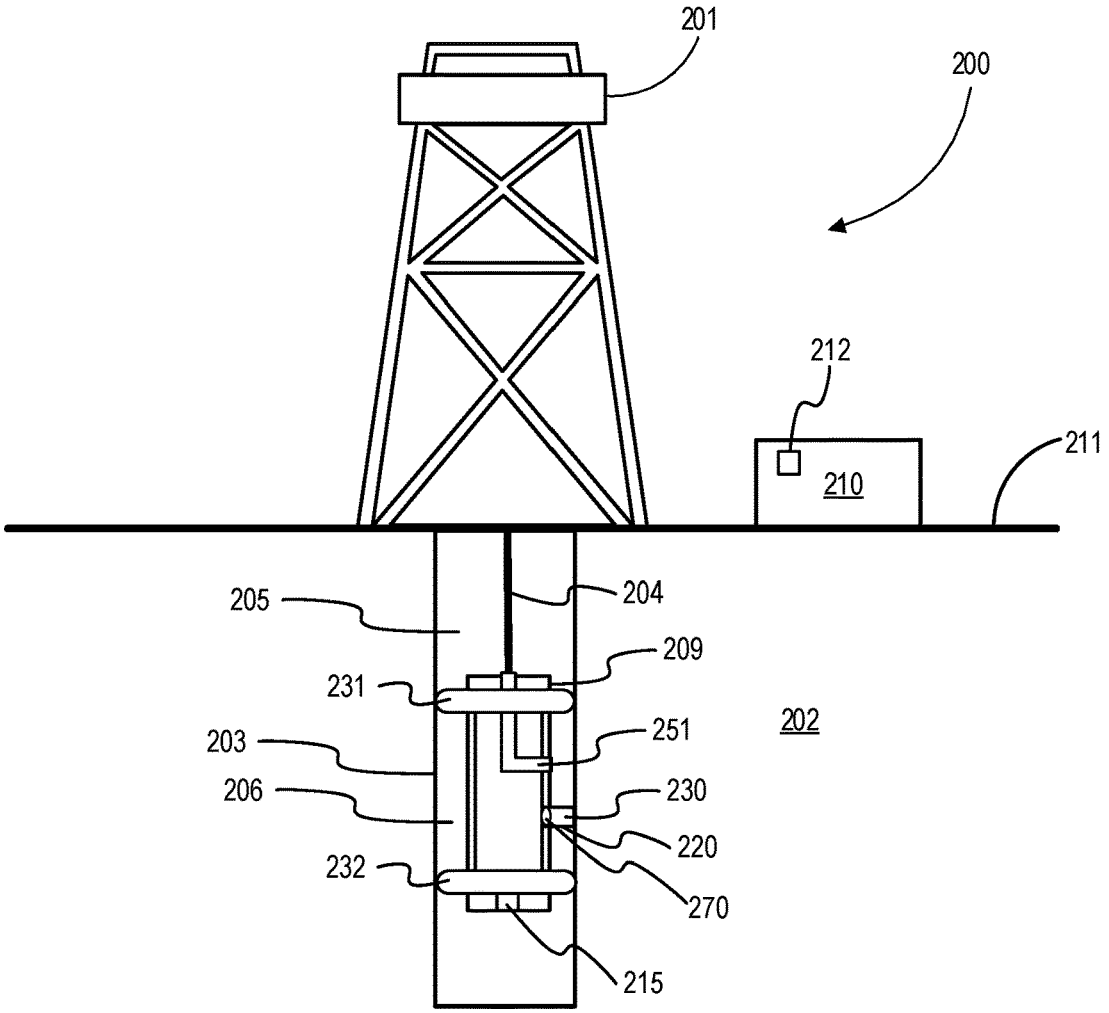
FIG. 2 is an elevation view of an onshore wireline system operating a formation tester tool that includes a pressure measurement system having both pads and a pad.

FIG. 2 is an elevation view of an onshore wireline system operating a formation tester tool that includes a pressure measurement system having both pads and a pad. A wireline system 200 includes a rig 201 located at a surface 211 and positioned above a borehole 203 within a subterranean formation 202. The wireline system 200 can include a wireline 204 supporting a formation tester tool 209 that includes tool packers 231-232 and a pad 220. The pad 220 can extract and isolate a formation fluid sample from its radially outward end. The tool packers 231-232 can radially expand from the formation tester tool 209 until they form a sealed volume 206 that is isolated from the exposed borehole region 205. The formation tester tool 209 can also include a fluid extraction path 251 that can extract fluid from the sealed volume 206 into the formation tester tool 209 and into a fluid conduit in the wireline 204. A surface system 210 located at the surface 211 can include a processor 212 and memory device and can communicate with components of the formation tester tool 209 such as the tool packers 231-232 and the pad 220.

During pressure measurement operations, the pad 220 can form a sealed connection volume 230 with a wall of the borehole 203, wherein fluids in the sealed connection volume 230 can be isolated from fluids flowing in the exposed borehole region 205 or from fluids in the sealed volume 206. Similarly, the tool packers 231-232 can be activated to form the sealed volume 206, wherein fluids in the sealed volume 206 can be isolated from fluids flowing in the exposed borehole region 205. In addition, the sealed volume 206 can be isolated from fluids in the sealed connection volume 230 while the pad 220 forms a sealed connection volume 230 with the wall of the borehole 203.

A pressure sensor 270 of the pad 220 can acquire a first pressure measurement from fluids within the sealed connection volume 230. In some embodiments, one or both of the tool packers 231-232 form part of a pressure control system that can extract fluid from the sealed volume 206 via one or more fluid conduits in one or both the tool packers 231-232.

Alternatively, or in addition, a pressure control system can include the combination of tool packers 231-232 and equipment in the formation tester tool 209 that can extract fluid from the sealed volume 206 through the fluid extraction path 251. The pressure control system can extract fluid from the sealed volume 206 to reduce the pressure around the pad 220 during a first depressurization interval to a pressure lower than at least one of the borehole pressure and the first pressure measurement. The system can acquire a second pressure measurement using the pressure sensor 270 during or after the depressurization interval. The system can then perform at least one additional iteration to acquire one or more pressure measurements using the pressure sensor 270, wherein the iteration includes a buildup operation, a drawdown operation, and an operation to reduce the pressure around the sealed connection volume 230 during another depressurization interval. As described further below in the description corresponding with the flowchart 800 of FIG. 8, the system can perform repeated iterations of these operations to determine a measurement pattern for predicting one or more formation properties based on the formation pressure trend.

In some embodiments, the wireline 204 can transmit pressure measurements from the formation tester tool 209 to the surface 211 via the wireline 204. In some embodiments, the results provided from a processor 215 in the formation tester tool 209 using the operations disclosed below for the flowchart 800 of FIG. 8 can be transmitted via the wireline 204. Alternatively, or in addition, pressure measurements and/or the results based on the pressure measurements can be communicated via fluid pulses traveling through fluids in the borehole 203 or via electromagnetic signals directed to the surface 211. Once at the surface 211, the pressure measurements and/or results based on the pressure measurements can be communicated to the processor 212 in the surface system 210. In addition, the wireline 204 can include a fluid tube through which fluid extracted by the formation tester tool 209 can be passed to the surface.

Figure 3:
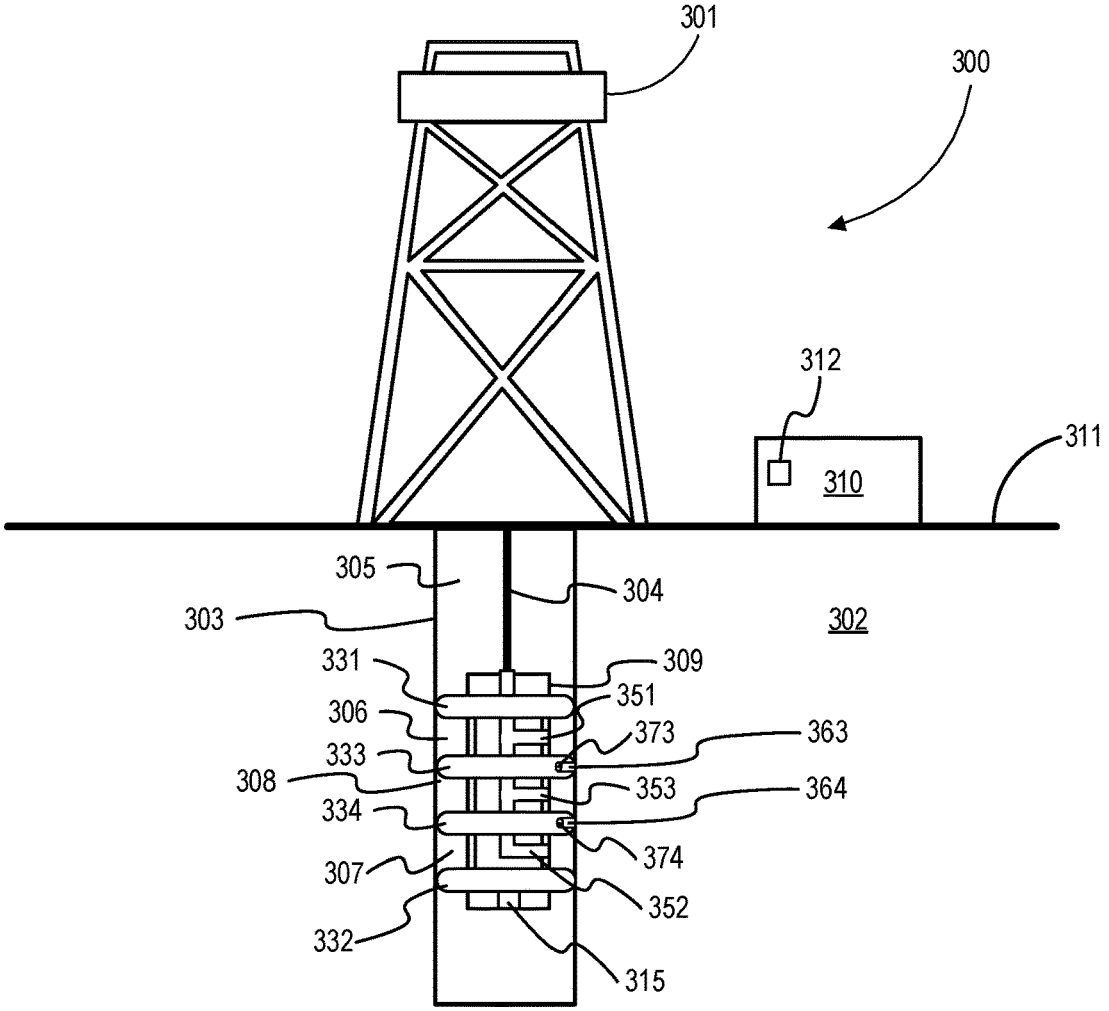
FIG. 3 is an elevation view of an onshore wireline system operating a formation tester tool that includes a pressure measurement system having pads.

FIG. 3 is an elevation view of an onshore wireline system operating a formation tester tool that includes a pressure measurement system having pads. A wireline system 300 includes a rig 301 located at a surface 311 and positioned above a borehole 303 within a subterranean formation 302. The wireline system 300 can include a wireline 304 supporting a formation tester tool 309 that includes outer tool packers 331-332 and inner tool packers 333-334 between the outer tool packers 331-332. The outer tool packers 331-332 and inner tool packers 333-334 can radially expand from the formation tester tool 309 until they form sealed volumes 306-308, each of which can be isolated from the exposed borehole region 305. As shown in FIG. 3, radially expanding different combinations of the inner and outer tool packers 331-334 can form different sections of the sealed volumes 306-308. Radially expanding the inner tool packer 333 and outer tool packer 331 can form the sealed volume 306. Radially expanding the inner tool packer 334 and outer tool packer 332 can form the sealed volume 307. Radially expanding the inner tool packers 333-334 can form the sealed volume 308.

The formation tester tool 309 can also include a fluid extraction path 351, wherein the formation tester tool 309 can extract fluid from the sealed volume 306 into the formation tester tool 309 through the fluid extraction path 351. Similarly, the formation tester tool 309 can extract fluid from the sealed volumes 307 and 308 via fluid extraction paths 352 and 353 respectively. A surface system 310 located at the surface 311 can include a processor 312 and memory device and can communicate with components of the formation tester tool 309 such as the outer tool packers 331-332 and the inner tool packers 333-334.

During pressure measurement operations, each of the outer tool packers 331-332 and the inner tool packers 333-334 can radially expand to form the sealed volumes 306-308. In some embodiments, one or both of the inner tool packers 333-334 can include equipment that can be used to acquire a formation pressure measurement. Radial expansion of the inner tool packer 333 can result in a sealed connection volume 363 between the inner tool packer 333 and a wall of the borehole 303, wherein the sealed connection volume 363 includes a pressure sensor 373. Fluids in the sealed connection volume 363 can be isolated from fluids in the sealed volumes 306 and 308 surrounding the sealed connection volume 363. Similarly, radial expansion of the inner tool packer 334 can result in a sealed connection volume 364 between the inner tool packer 334 and a wall of the borehole 303, wherein the sealed connection volume 364 includes a pressure sensor 374. Fluids in the sealed connection volume 364 can be isolated from fluids in the sealed volumes 307 and 308 surrounding the sealed connection volume 364.

The pressure sensor 373 of the inner tool packers 333 can acquire a first pressure measurement from fluids within the sealed connection volume 363. Similarly, the pressure sensor 374 of the inner tool packers 334 can acquire a first pressure measurement from fluids within the sealed connection volume 364. In some embodiments, one or more of the tool packers 331-334 can form a part of a pressure control system that can extract fluid from the sealed volumes 306-308. Alternatively, or in addition, a pressure control system can include the combination of some or all of the tool packers 331-334 and equipment in the formation tester tool 309 that can extract fluid from the sealed volumes 306-308 through the fluid extraction path 351-353. The formation tester tool 309 can then operate to extract fluid from the sealed volumes 306-308 through the fluid extraction paths 351-353, respectively, to reduce the pressure around the pressure sensors 373-374. The pressures around the pressure sensors 373-374 can be lowered to a value less than at least one of the borehole pressure and the first pressure measurement during a first depressurization interval. The wireline system 300 can acquire a second pressure measurement using at least one of the pressure sensors 373-374 during or after the depressurization interval. The system can then perform at least one additional iteration to acquire one or more pressure measurements using the pressure sensor 370, wherein the iteration can include a buildup operation, a drawdown operation, and an operation to reduce the pressure around the sealed connection volume 330 during another depressurization interval. As described further below in the description corresponding with the flowchart 800 of FIG. 8, the system can perform repeated iterations of these operations to determine a measurement pattern for predicting one or more formation properties based on the formation pressure trend.

In some embodiments, the wireline 304 can transmit pressure measurements from the formation tester tool 309 to the surface 311 via the wireline 304. In some embodiments, the results provided from a processor 315 in the formation tester tool 309 using the operations disclosed below for the flowchart 800 of FIG. 8 can be transmitted via the wireline 304. Alternatively, or in addition, pressure measurements and/or the results based on the pressure measurements can be communicated via fluid pulses traveling through fluids in the borehole 303 or via electromagnetic signals to the surface 311. Once at the surface 311, the pressure measurements and/or results based on the pressure measurements can be communicated to the processor 315 in the surface system 310. In addition, the wireline 304 can include a fluid tube through which fluid extracted by the formation tester tool 309 can be passed to the surface.

Figure 4:
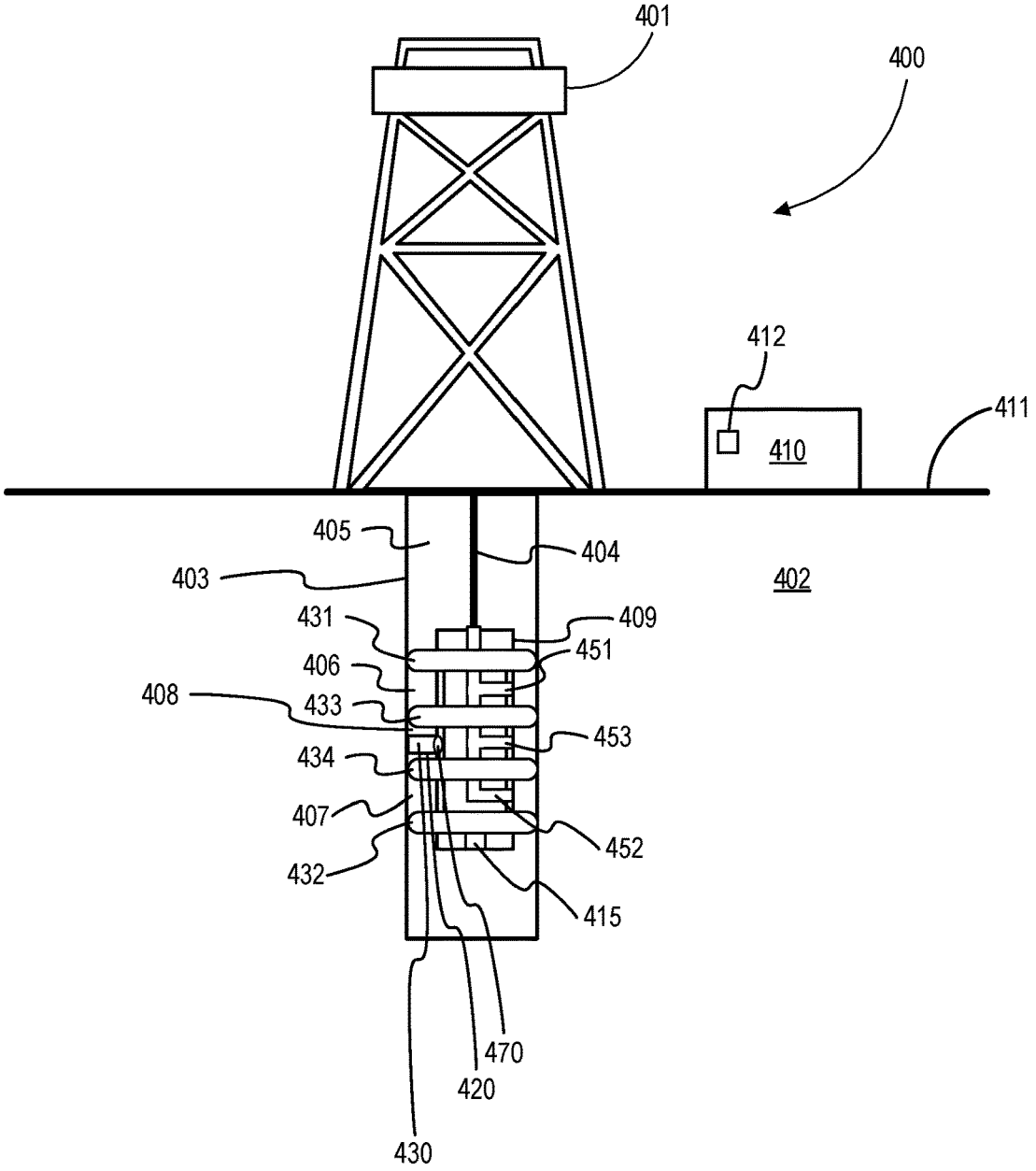
FIG. 4 is an elevation view of an onshore wireline system operating a formation tester tool that includes a pressure measurement system having four pads and a pad.

FIG. 4 is an elevation view of an onshore wireline system operating a formation tester tool that includes a pressure measurement system having four pads and a pad. A wireline system 400 includes a rig 401 located at a surface 411 and positioned above a borehole 403 within a subterranean formation 402. The wireline system 400 can include a wireline 404 supporting a formation tester tool 409 that includes outer tool packers 431-432, inner tool packers 433-434 between the outer tool packers 431-432 with respect to the axis of the formation tester tool 409, and a pad 420 between the inner tool packers 433-434. The outer tool packers 431-432 and inner tool packers 433-434 can radially expand from the formation tester tool 409 until they form sealed volumes 406-408, each of which can be isolated from the exposed borehole region 405. As shown in FIG. 4, radially expanding different combinations of the inner and outer tool packers 431-434 can form different sections of the sealed volumes 406-408. Radially expanding the inner tool packer 433 and outer tool packer 431 can form the sealed volume 406. Radially expanding the inner tool packer 434 and outer tool packer 432 can form the sealed volume 407. Radially expanding the inner tool packers 433-434 can form the sealed volume 408, wherein the pad 420 is within the sealed volume 408.

The formation tester tool 409 can also include a fluid extraction path 451, wherein the formation tester tool 409 can extract fluid from the sealed volume 406 into the formation tester tool 409 through the fluid extraction path 451. Similarly, the formation tester tool 409 can extract fluid from the sealed volumes 407 and 408 via fluid extraction paths 452 and 453 respectively. A surface system 410 located at the surface 411 can include a processor 412 and memory device and can communicate with components of the formation tester tool 409 such as the outer tool packers 431-432 and the inner tool packers 433-434.

During pressure measurement operations, the pad 420 can radially extend with respect to the axis of the formation tester tool 409 to form a sealed connection volume 430 with a wall of the borehole 403. Fluids in the sealed connection volume 430 can be isolated from fluids flowing in the exposed borehole region 405 or from fluids in the sealed volume 408 that surrounds the pad 420. In addition, each of the outer tool packers 431-432 and the inner tool packers 433-434 can radially expand to form the sealed volumes 406-408. For example, the tool packers 433-434 can be activated to form the sealed volume 408, wherein fluids in the sealed volume 408 can be isolated from fluids flowing in the exposed borehole region 405 or from the sealed volumes 406-407. In addition, the sealed volume 408 can be isolated from fluids in the sealed connection volume 430 formed by the pad 420. In some embodiments, each of the sealed volumes 406-408 can be formed to increase the isolation with respect to any materials in the sealed connection volume 430.

A pressure sensor 470 of the pad 420 can acquire a first pressure measurement from fluids within the sealed connection volume 430. In some embodiments, one or more of the tool packers 431-434 can form a part of a pressure control system that can extract fluid from the sealed volumes 406-408. Alternatively, or in addition, a pressure control system can include the combination of some or all of the tool packers 431-434 and equipment in the formation tester tool 409 that can extract fluid from the sealed volumes 406-408 through the fluid extraction path 451-453. The formation tester tool 409 can then operate to extract fluid from the sealed volumes 406-408 through the fluid extraction paths 451-453. Extracting fluid from the sealed volume 408 can reduce the pressure around the pad 420 during a first depressurization interval to a pressure lower than at least one of the borehole pressure and the first pressure measurement. Extracting fluid from the sealed volumes 406-407 can increase the pressure reduction effect. The system can acquire a second pressure measurement using the pressure sensor 470 during or after the depressurization interval. The system can then perform at least one additional iteration to acquire one or more pressure measurements using the pressure sensor 470, wherein the iteration includes a drawdown operation, a buildup operation and an operation to reduce the pressure around the sealed connection volume 430 during another depressurization interval. As described further below in the description corresponding with the flowchart 800 of FIG. 8, the system can perform repeated iterations of these operations to determine a measurement pattern for predicting one or more formation properties based on the formation pressure trend.

In some embodiments, the wireline 404 can transmit pressure measurements from the formation tester tool 409 to the surface 411 via the wireline 404. In some embodiments, the results provided from a processor 415 in the formation tester tool 409 using the operations disclosed below for the flowchart 800 of FIG. 8 can be transmitted via the wireline 404. Alternatively, or in addition, pressure measurements and/or the results based on the pressure measurements can be communicated via fluid pulses traveling through fluids in the borehole 403 or via electromagnetic signals to the surface 411. Once at the surface 411, the pressure measurements and/or results based on the pressure measurements can be communicated to the processor 415 in the surface system 410.

Example Drilling System

Figure 5:
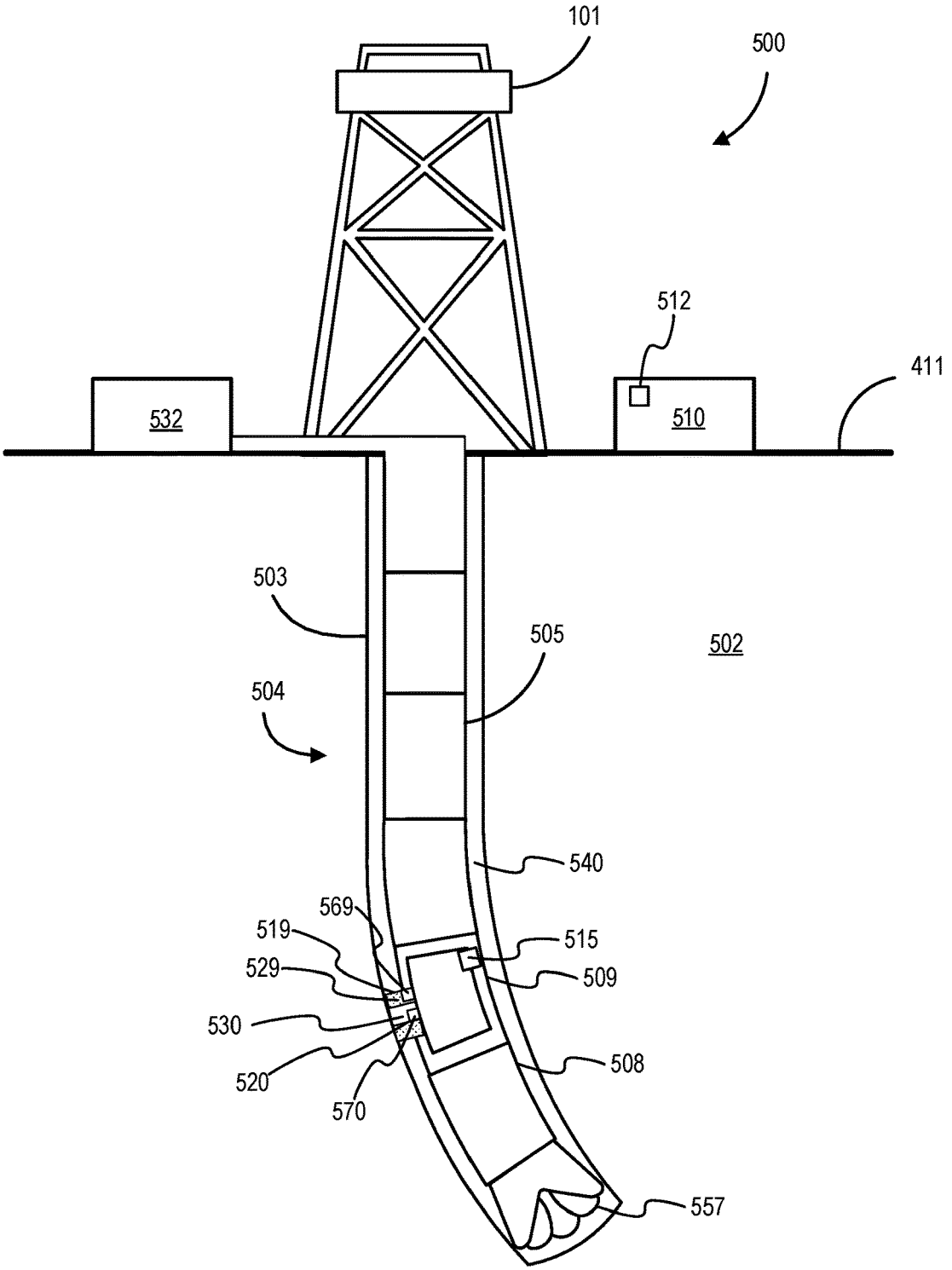
FIG. 5 is an elevation view of an onshore drilling system operating a downhole drilling assembly that includes a pressure measurement system having pads.

FIG. 5 is an elevation view of an onshore drilling system operating a downhole drilling assembly that includes a pressure measurement system having pads. A drilling system 500 includes a rig 501 located at a formation surface 511 and positioned above a borehole 503 within a subsurface formation 502. In some embodiments, a drilling assembly 504 can be coupled to the rig 501 using a drill string 505. The drilling assembly 504 can include a bottom hole assembly (BHA). The BHA can include a drill bit 557, a steering assembly 508, and a logging-while-drilling (LWD)/measurement-while-drilling (MWD) apparatus having a formation tester tool 509. The formation tester tool 509 can include an inner pad 520 and an outer pad 519, either which can be used to isolate a fluid to acquire pressure measurements. The formation tester tool 509 or another component of the BHA can also include a first processor 515 to perform operations and generate results based on the measurements made by the formation tester tool 509.

During drilling operations, a mud pump 532 may pump drilling fluid into the drill string 505 and down to the drill bit 557. The drilling fluid can flow out from the drill bit 557 and be returned to the formation surface 511 through an annular area 540 between the drill string 505 and the sides of the borehole 503. In some embodiments, the drilling fluid can be used to cool the drill bit 557, as well as to provide lubrication for the drill bit 557 during drilling operations. Additionally, the drilling fluid may be used to remove subsurface formation 502 cuttings created by operating the drill bit 557.

Measurements or generated results can be transmitted to the formation surface 511 using mud pulses (or other physical fluid pulses) traveling through the drilling mud (or other fluid) in the borehole 503. These mud pulses can be received at the formation surface 511 and communicated to a second processor 512 in the control and surface system 510 located at the formation surface 511.

During pressure measurement operations, the inner pad 520 can form an inner sealed connection volume 530 with a wall of the borehole 503, wherein fluids in the inner sealed connection volume 530 can be isolated from fluids flowing in the annular area 540 or from fluids in the outer sealed connection volume 529. Similarly, the outer pad 519 can form an outer sealed connection volume 529 with the wall of the borehole 503, wherein fluids in the outer sealed connection volume 529 can be isolated from fluids flowing in the annular area 540 or from fluids in the inner sealed connection volume 530. As it is to be understood in this disclosure, a sealed connection volume refers to a volume having a sealed connection between a borehole wall and a pad or other enclosed space of the formation tester tool 509.

A pressure sensor 570 of the inner pad 520 can acquire a first pressure measurement from fluids within the inner sealed connection volume 530. The outer pad 519 can then reduce the pressure around the inner pad 520 during a first depressurization interval to a pressure lower than at least one of the borehole pressure and the first pressure measurement by drawing fluid into the formation tester tool 209 through the outer sealed connection volume 529, wherein the pressure in the outer sealed connection volume 529 can be measured by a pressure sensor 569.

The drilling system 500 can acquire a second pressure measurement using the pressure sensor 570 during or after the depressurization interval. The drilling system 500 can then perform at least one additional iteration of acquiring one or more the pressure measurements using the pressure sensor 570 while performing a drawdown through the inner sealed connection volume 530 and reducing the pressure around the inner pad 520 using the outer pad 519 during another depressurization interval. As described further below in the description corresponding with FIG. 8, the system can perform at least one additional iteration to acquire one or more pressure measurements using the pressure sensor 570, wherein the iteration includes a buildup operation, a drawdown operation, and an operation to reduce the pressure around the sealed connection volume 530 during another depressurization interval. As described further below in the description corresponding with FIG. 8, the system can perform repeated iterations of these operations to determine a measurement pattern for predicting one or more formation properties based on the formation pressure trend.

Example Pad

Figure 6:
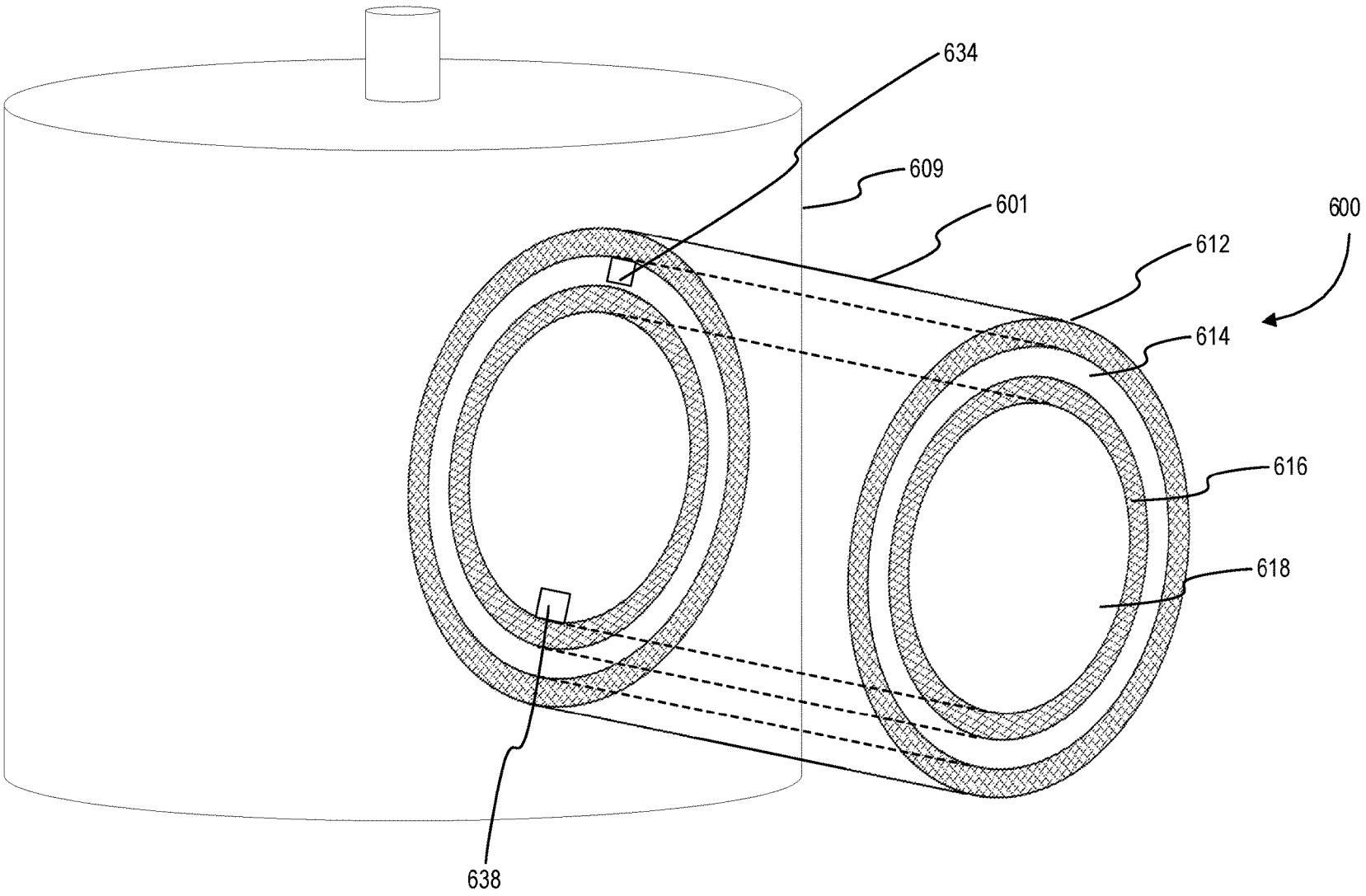
FIG. 6 is an isometric view of a first pad that is concentric with a second pad.

FIG. 6 is an isometric view of a first pad that is concentric with a second pad. FIG. 6 shows a portion of a formation tester tool 609 comprising a pad device 601. The pad device 601 includes an outer pad comprising an outer pad wall 612 surrounding an outer pad volume 614, wherein a pressure sensor 634 is within the outer pad volume 614. The pad device 601 also includes an inner pad comprising an inner pad wall 616 surrounding an inner pad volume 618 surrounded by the inner pad wall 616 and a pressure sensor 638 within the inner pad volume 618. The pressure sensor 634 can measure the pressure of the outer pad volume 614 and the pressure sensor 638 can measure the pressure of the inner pad volume 618. With further reference to FIG. 1, the pressure sensor 169 can be similar to or the same as the pressure sensor 634 and the pressure sensor 170 can be similar to or the same as the pressure sensor 170. With further respect to FIG. 1, the outer pad of FIG. 6 can be similar to or the same as the outer pad 119 and the inner pad of FIG. 6 can be similar to or the same as the inner pad 120.

During a pressure measurement operation, the pad device 601 can be extended such that ends of the outer pad wall 612 and the inner pad wall 616 sealingly engage with a borehole wall. Such sealing engagement can convert the outer pad volume 614 into an outer sealed connection volume and the inner pad volume 618 into an inner sealed connection volume. In some embodiments, formation fluid can flow into the inner pad volume 618 and the pressure of this formation fluid can be measured by the pressure sensor 638. Similarly, formation fluid can flow into the inner pad volume 618 and the pressure of this formation fluid can be measured by the pressure sensor 638. The formation tester tool 609 can extract fluid through the outer pad volume 614 until the pressure of the outer pad volume 614, as measured by the pressure sensor 634, is less than the pressure of the inner pad volume 618, as measured by the pressure sensor 638.

Example Data

Figure 7:
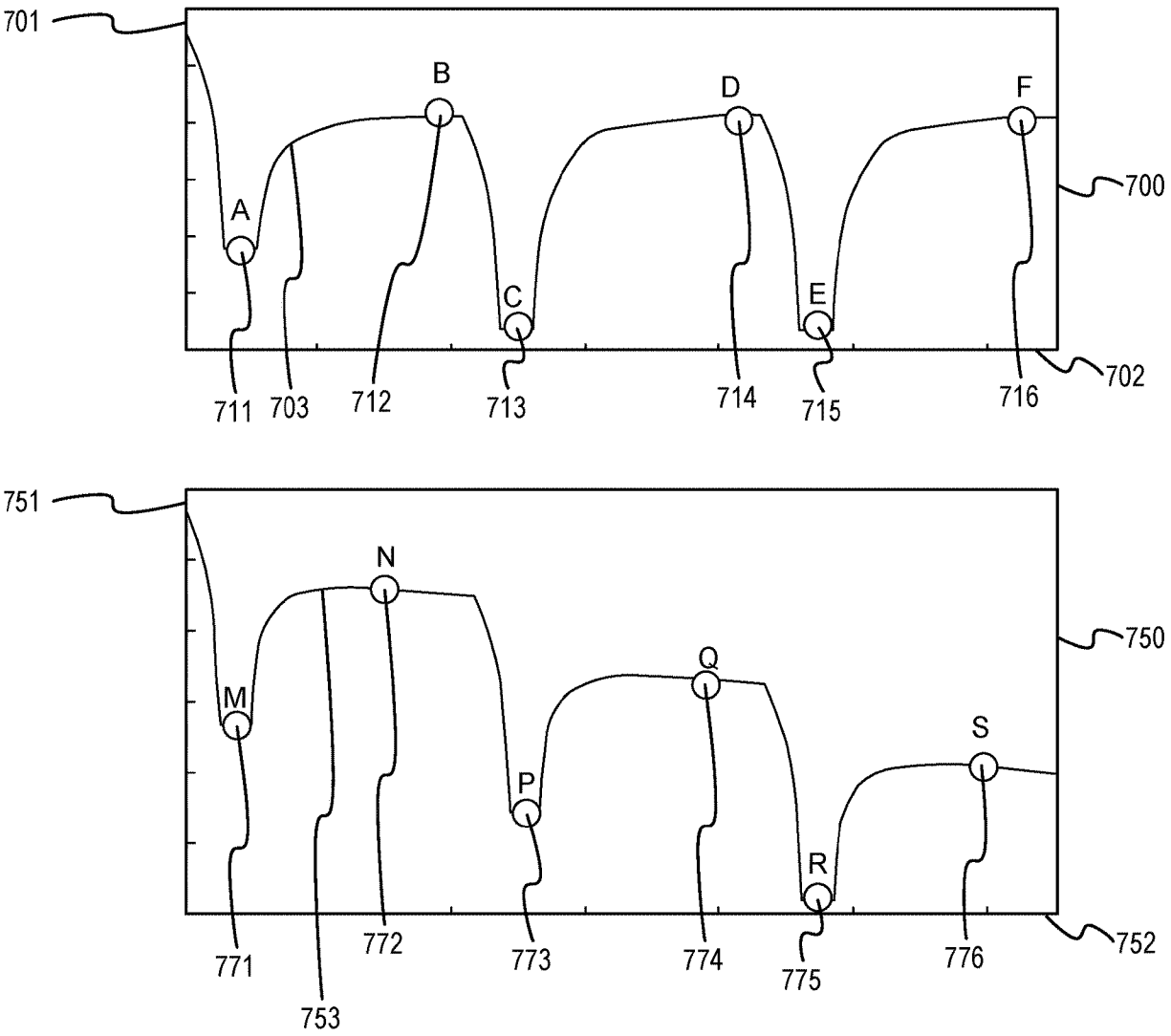
FIG. 7 are two plots showing different pressure patterns during a series of buildup and drawdown cycles.

FIG. 7 are two plots showing different pressure patterns during a series of buildup and drawdown cycles. The first plot 700 depicts a first set of pressure measurements over time during repeated drawdown iterations while the outer pressure is reduced. The vertical axis 701 represents pressure measurements, which can be units such as pounds per square inch (psi) or kilopascals (kPa). The horizontal axis 702 represents time, which can be measured in units such as seconds, minutes, hours, or days. The trendline 703 represents pressure measurements over time.

In some embodiments, buildup can naturally occur after depressurization, wherein fluid flow from the formation to the surface is stopped. During buildup, formation fluid can flow to fill the depressurized region around the wellbore at the point of contact with a probe. This phenomenon can cause a pressure rebound that can be measured by a pressure sensor, wherein the pressure can asymptotically approach the formation pressure over time. As the pressure stabilizes over time, the late time pressure measurement can be indicative of a sandface pressure or even a formation pressure.

In some embodiments, the time corresponding with a "late time" can be determined as the time during and after the period when the pressure measurement or other measurement correlated with pressure is determined to be stable. As used in this disclosure, a pressure can be determined to be stable based on various methods. In some embodiments, an operation can determine that a measurement is stable based on statistical methods. For example, an operation can determine that a pressure is stable based on whether a portion of a measured pressure with respect to time can be fitted to a measurement pattern such as a linear segment, wherein a determination that the slope of the linear segment satisfies its corresponding slope threshold is indicative of stability. As another example, an operation can determine that a pressure is stable based on whether the standard deviation of a portion of a measured pressure with respect to time satisfying its corresponding slope threshold is indicative of stability.

In some embodiments, an operation can determine that a measurement is stable based on analytical methods. For example, an operation can determine that a pressure measurement is stable based on an implementation of Darcy's flow equations to determine whether the rebound of a fluid pressure can be described as asymptotic. Alternatively, or in addition, operation can determine that a pressure measurement is stable based on approximate flow equations to determine whether the rebound of a fluid pressure can be described as asymptotic.

Each of the points 711-715 represent different pressure measurements acquired by a pressure sensor over an increasing time period. Point A 711 represents a pressure measurement after an initial buildup/drawdown after a pressure buildup, wherein a buildup operation comprises preventing formation fluid from escaping the formation. Point B 712 represents a pressure measurement during a second buildup. Point C 713 represents a pressure measurement after a second drawdown after the second buildup while a pressure surrounding the pressure sensor is reduced. Point D 714 represents a pressure measurement during a third buildup. Point E 715 represents a pressure measurement after a third drawdown after the third buildup while a pressure surrounding the pressure sensor is reduced. Point F 716 represents a pressure measurement during a fourth buildup. In some embodiments, each of points B 712, D 714 and F 716 can be considered to be build-up pressures corresponding with a late time based on one or more of the analytical or statistical operations described above.

A system having a processor can analyze some or all of the points 711-716 to determine a measurement pattern, wherein a measurement pattern can be any function fitted to at least a subset of the analyzed points. For example, a measurement pattern can be represented as a horizontal line that indicates that a pressure measurement value is constant. Alternatively, the measurement pattern can be represented as an asymptotic curve and the measurement pattern can be analyzed to predict an asymptotic value representing a formation pressure value. In addition, the system can include other points along the trendline 703 in its analysis.

Based on a pattern of the plurality of the points 711-716, the system can determine a formation pressure value. For example, the system can determine that the pressure difference between Point A and Point C is equal greater than a pressure similarity threshold, and that the value is still declining, whereas the pressure difference between Point C 713 and Point E 715 satisfy a pressure similarity threshold. In some embodiments, the pressure similarity threshold can be equal to a pre-set value, such as a value ranging between 0 psi to 100 psi. Alternatively, or in addition, the system can determine a formation pressure value based on an asymptotic value of the measurements. For example, the system can analyze the points corresponding with the buildup pressure (e.g. Point B 712, Point D 714, and point F 716) and determine that the buildup trend has reached an asymptotic value of 5000 psi based on each of the three points being within a threshold distance of an average value of the set of three points, and that this asymptotic value is the formation pressure.

The second plot 750 depicts a first set of pressure measurements over time during a repeated buildup/drawdown iterations when the formation pressure is artificially influenced. For example, the formation pressure can be artificially influenced during supercharging, wherein the formation pressure is affected by active invasion from a borehole pressure. The vertical axis 751 represents pressure measurements, which can be units such as psi or kPa. The horizontal axis 752 represents time, which can be measured in units such as seconds, minutes, hours, or days. The trendline 753 represents pressure measurements over time.

Each of the points 771-775 represent different pressure measurements acquired by a pressure sensor over time. Point M 771 represents a pressure measurement after an initial drawdown after a pressure buildup. Point N 772 represents a pressure measurement during a second buildup. Point P 773 represents a pressure measurement after a second drawdown after the second buildup. Point Q 774 represents a pressure measurement during a third buildup. Point R 775 represents a pressure measurement after a third drawdown after the third buildup. Point S 776 represents a pressure measurement during a fourth buildup. As shown in the second plot 750, the pressure measurements corresponding with each drawdown valley (e.g. Point M 771, Point P 773 and Point R 775) are lower than the last, and can approach an asymptotic value over time that can be based on a borehole pressure and can be greater than an actual formation pressure.

In some embodiments, point N 772, point Q 774 and/or point S 776 can be considered to be build-up pressures corresponding with a late time based on one or more of the analytical or statistical operations described above. Alternatively, an operation can determine that these points do not correspond with a late time. For example, as further described below in the description for the flowchart 800, an operation can determine that a pressure trend during buildup deviates from an expected Darcy profile, and/or that the deviation corresponds with a phenomenon such as supercharging. In response to the trend deviation, the operation can include reducing an outer volume pressure until a Darcy profile is achieved on the center volume.

A system having a processor can analyze some or all of the points 771-776 to determine a measurement pattern, wherein a measurement pattern can be any predicted trend or function fitted to at least a subset of the analyzed points. For example, a measurement pattern can be represented as a horizontal line that indicates that a pressure measurement value is constant. Alternatively, the measurement pattern can be represented as an asymptotic curve and the measurement pattern can be analyzed to predict an asymptotic value representing an actual pressure. In addition, the system can include other points along the trendline 753 in its analysis.

Based on a pattern of the plurality of the points 771-776, the system can determine a pressure measurement value based on the buildup pressure measurements as the formation pressure. However, as discussed above, a pressure measurement value can be greater than the corresponding actual formation pressure when the formation pressure is artificially influenced.

Example Flowchart

The flowcharts described below are provided to aid in understanding the illustrations and should not to be used to limit the scope of the claims. Each flowchart depicts example operations that can vary within the scope of the claims. Additional operations may be performed; fewer operations may be performed; the operations shown may be performed in parallel; and the operations shown may be performed in a different order. For example, the operations depicted in blocks 804-832 of FIG. 8 can be performed in parallel or serially for multiple pressure measurement systems. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus, for execution.

Figure 8:
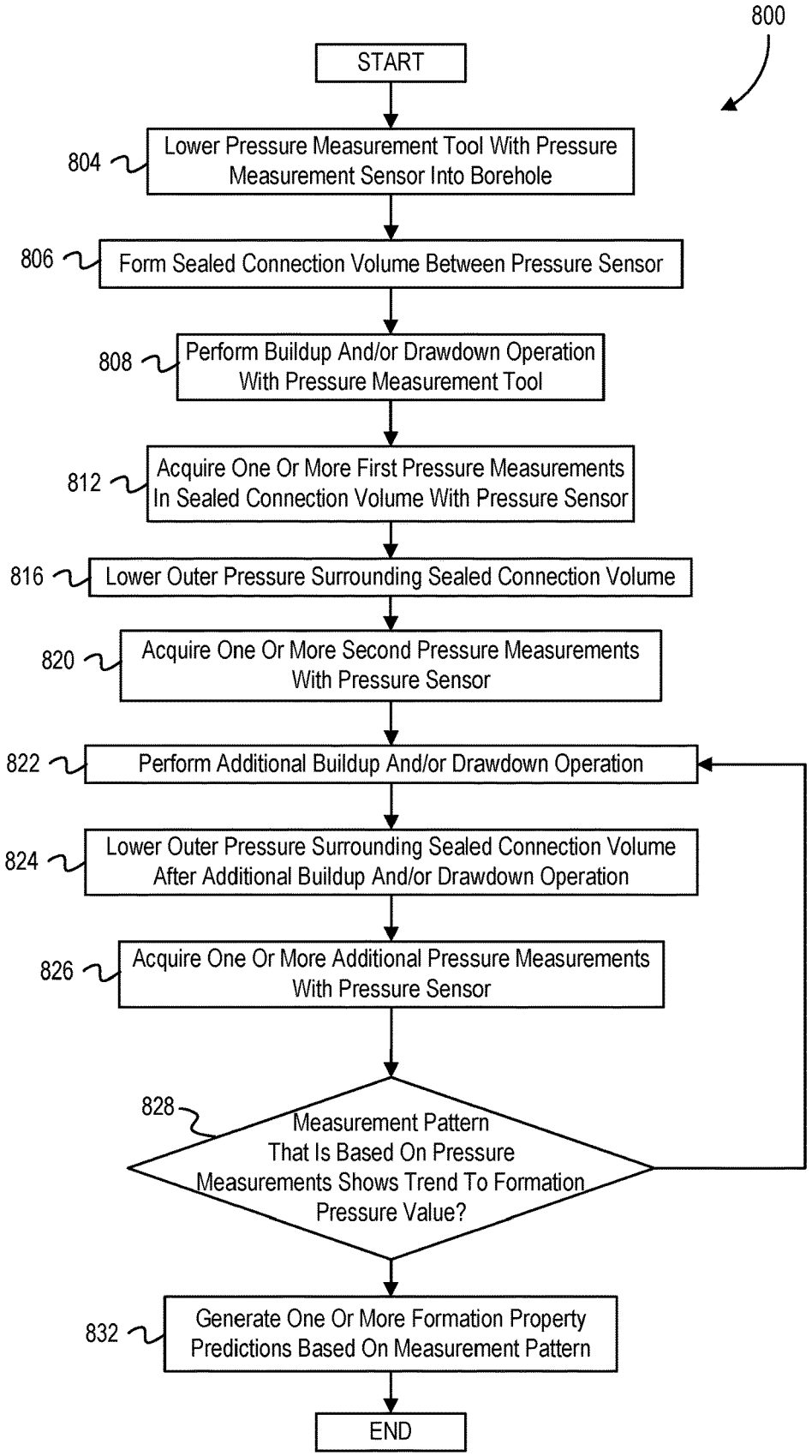
FIG. 8 is a flowchart of operations to measure a formation pressure.

FIG. 8 is a flowchart of operations to measure a formation pressure. FIG. 8 depicts a flowchart 800 of operations to generate one or more formation property predictions using a device or system that includes a processor. For example, operations of the flowchart 800 can be performed using a system similar to the surface systems 110, 210, 310, 410, 510 and/or computer device 900 shown in FIG. 1, FIG. 2, FIG. 3, FIG. 4, FIG. 5 and FIG. 9, respectively. Operations of the flowchart 800 start at block 804.

At block 804, the device or system lowers a pressure measurement tool with a pressure sensor into a borehole. The pressure measurement tool can include a pressure measurement sensor. For example, with reference to FIG. 1 and FIG. 5, the pressure measurement tool can include the formation tester tool 109 or the formation tester tool 509. The pressure sensor can be any device capable of measuring formation pressure at a borehole wall, such as a pressure sensor within an extended pad or a pressure sensor attached to a sealing pad. In some embodiments, the pressure control system can include a pad surrounding the pressure sensor. For example, the pressure sensor can be inside a first pad and the pressure control system can be a second extended pad that is concentric with the first pad and has a greater radius than the first pad. Alternatively, or in addition, the pressure control system can include a set of pads surrounding the pressure sensor.

At block 806, the device or system can operate to form a sealed connection volume between the pressure sensor and a formation. In some embodiments, the device or system can control a pad and instruct the pad to extend and sealingly engage with a borehole wall of a formation until a hydraulic connection is formed with the formation. For example, with reference to FIG. 1, the inner pad 120 and outer pad 119 can extend to engage with the wall of the borehole 103 until fluid can flow from the formation 102 into the sealed connection volume 130 and not escape into the exposed borehole region 105. Alternatively, or in addition, the device or system can control a pad containing the pressure sensor to extend and sealingly engage with the borehole wall of a formation. For example, with reference to FIG. 3, the inner tool packer can be commanded to extend and form a sealing engagement with the borehole wall of a formation.

At block 808, the device or system can perform a buildup operation and/or drawdown operation with the pressure measurement tool. In some embodiments, the device or system can perform a buildup operation by stopping fluid flow through the formation tester tool, allowing a pressure to increase. For example, with reference to FIG. 1, the device or system can perform the buildup operation by stopping fluid flow from the formation 102. In some embodiments, the device or system can perform a drawdown operation after the buildup operation. In some embodiments, the device or system can perform the drawdown operation by allowing fluid to flow through the formation tester tool. For example, with reference to FIG. 1, the device or system can perform a drawdown by allowing fluid to flow through the inner pad 120. In addition, the device or system can allow fluid to flow around the formation tester tool. Alternatively, or in addition, the device or system can pressurize the entire borehole by injecting additional fluid into the borehole. For example, with reference to FIG. 1, the device or system can increase the pressure of the entire borehole 103. The pressure sensor can acquire one or more pressure measurements during any or all of the operations described for block 808. As described below for block 812, the device or system can acquire one or more first measurements while the system performs a buildup and/or drawdown operation. Alternatively, or in addition, the pressure sensor can acquire the one or more first measurements after the system has completed performing the buildup and/or drawdown operation.

At block 812, the device or system can acquire one or more first pressure measurements in a sealed connection volume using the pressure sensor. In some embodiments, the device or system can acquire the first pressure measurement of the fluid in the sealed connection volume within an extended pad. Alternatively, the device or system can acquire the first pressure measurement of a sealed connection volume within a tool packer. As used herein, it should be understood that a first pressure measurement is not required to be the initial pressure measurement taken during a series of measurements but is labeled as the first pressure measurement only with respect to the order of measurements with respect to the second pressure measurement described below. For example, the pressure sensor can have acquired an initial 5000 pressure measurements before acquiring the first pressure measurement described for block 812.

At block 816, the device or system can lower an outer pressure surrounding the sealed connection volume. In some embodiments, the sealed connection volume can be an inner sealed volume that is surrounded by an outer sealed volume, and the device or system can lower the outer pressure by lowering the fluid pressure in the outer sealed volume. For example, with reference to FIG. 1, the device or system can lower the fluid pressure in the outer sealed connection volume 129 that surrounds the inner sealed connection volume 130. In some embodiments, the device or system can lower the outer pressure to be less than or equal to 50% of at least one of the borehole pressure and/or one of the first pressure measurements to increase the probability that the system detects a measurement pattern, as further described for block 828. For example, the device or system can lower the outer pressure to be less than or equal to 50% of a maximum of the first pressure measurements. Alternatively, or in addition, the device or system can lower the outer pressure to be a value greater than 50% and less than 100% of the first pressure measurement. For example, the device or system can lower the outer pressure to be 75% of the first pressure measurement. As another example, the device or system can lower the outer pressure to be 50% or 75% of the borehole pressure. As further described below, the device or system can acquire one or more second measurements during the operations of block 816.

At block 820, the device or system can acquire one or more second pressure measurements with the pressure sensor. In some embodiments, the device or system can acquire the one or more second pressure measurements of the fluid in the sealed connection volume within an extended pad. Alternatively, the device or system can acquire the second pressure measurement(s) of a sealed connection volume within a tool packer. As used herein, it should be understood that a second pressure measurement is not required to be the pressure measurement acquired immediately after acquisition of the first pressure measurement, but is labeled as the second pressure measurement only with respect to the order of measurements with respect to the first pressure measurement(s) described below. For example, the pressure sensor can have acquired a subsequent 50 pressure measurements after acquiring the first pressure measurement and before acquiring the second pressure measurement.

At block 822, the device or system can perform an additional buildup operation and/or drawdown operation. The system can perform the additional buildup and/or drawdown operation using the same parameters as the buildup/drawdown operation for block 808.

Alternatively, the device or system can perform the additional buildup and/or drawdown operation using different parameters from one or more previous iterations of buildup/drawdown operations. For example, the device or system can increase a buildup time decrease a buildup time, increase a drawdown time, or decrease a drawdown time relative to a previous buildup and/or drawdown operation.

At block 824, the device or system can lower the outer pressure surrounding the sealed connection volume during or after the buildup/drawdown operation. The system can lower the outer pressure to the same lowered pressure value used at block 816. Alternatively, the device or system can lower the outer pressure to a different pressure value based on an updated borehole pressure and/or an updated pressure measurement. For example, the device or system can lower the outer pressure to 300 psi for operations corresponding with block 816 and lower the outer pressure to 250 psi for operations corresponding with block 826 based on a previous pressure measurement being less than a first pressure measurement.

At block 826, the device or system can acquire one or more additional pressure measurements with the pressure sensor. In some embodiments, the device or system can acquire additional pressure measurements during and/or after the operations described for block 824. For example, the device or system can begin to acquire one or more additional pressure measurements during a buildup operation and continue to acquire the additional pressure measurements after a subsequent drawdown operation. In some embodiments, a subset of the set of measurements including the one or more first pressure measurements, the one or more second pressure measurements and the one or more additional pressure measurements can be described as a series of pressure measurements.

At block 828, the system determines whether a measurement pattern that is based on the pressure measurements shows a trend to a formation pressure value. In some embodiments, the device or system can determine a measurement pattern based a fitted curve, wherein the fitted curve is fitted to a series of pressure measurements that includes some or all of the first measurement(s), second measurement(s), and/or additional measurement(s) described above. In some embodiments, the fitted curve of the plurality of pressure measurements can be described by functions such as Equations 1 and 2 below, wherein P is a pressure value, b is a constant value, e is Euler's number, and t is time:

$$P=b \tag{1}$$

$$P=be^{-t} \tag{2}$$

For example, the fitted curve can be fitted to the three or five most recent pressure measurements taken during or a buildup operation. In response to determining that the confidence value corresponding to the fitted curve satisfies a confidence threshold, the device or system can determine that a measurement pattern has been detected. The system can then determine that the measurement pattern shows a trend to a formation pressure value by analyzing the measurement pattern to determine a constant value or asymptotic value to represent the formation pressure value. Alternatively, or as an additional threshold, the device or system can use other statistical or data-based thresholds to detect a measurement pattern, such as a statistical deviation, variance, etc. For example, the device or system can determine whether a standard deviation corresponding with the fitted curve satisfies a statistical deviation threshold and, in response to determining that both a confidence interval and a standard deviation threshold are satisfied, determine that a measurement pattern has been detected. As described further below for block 832, the device or system can then select a statistical average such as a mean pressure measurement value or median pressure measurement value to represent the formation pressure value.

Alternatively, or in addition, the system can determine whether a set of pressure measurements trend to a formation pressure based on an implementation of Darcy's equations and/or approximate flow equations. For example, the system can determine that a set of measurements do not trend to a formation pressure based on a determination that the set of measurements do not show an expected Darcy profile. In some embodiments, the system can determine that a deviation from the expected Darcy profile corresponds specifically to a supercharging phenomenon.

In some embodiments, the values used to determine whether a measurement pattern shows a trend to a formation pressure can be different from the values of the measurement pattern used to determine the formation pressure. For example, the device or system can use a first set of pressure measurements fitted by a function to determine that a measurement pattern has been detected, wherein the first set of pressure measurements are each acquired after a drawdown operation and before a buildup operation. The system can then use a second set of pressure measurements to determine an actual formation pressure, wherein the second set of pressure measurements are each acquired during a buildup operation.

As described above, the lower the ratio between the outer pressure surrounding the sealed connection volume and the pressure inside the sealed connection volume, the faster the rate at which the pressure measurements converge to a steady state formation pressure value. Thus, the lower the ratio between the lowered outer pressure and the inner pressure of the sealed connection volume, the greater the probability that the device or system can detect whether a measurement pattern shows a trend to a formation pressure value for any particular iteration of the operations described for block 822, block 824, block 826 and block 828. If the system determines a pressure trend is detected, the device or system can proceed to block 832. Otherwise, the device or system can return to block 808.

At block 832, the device or system can generate one or more formation property predictions based on the measurement pattern. In some embodiments, the formation property prediction can be the formation pressure value itself. For example, after determining that the measurement pattern is sufficiently similar to an average pressure value based on a previous three pressure measurements at the end of the most recent three buildups each being within a threshold range of the average pressure value, the device or system can set the formation pressure value to be equal to the average pressure value. In some embodiments, the device or system can have a pre-established rule that establishes the formation pressure as an average of pressure measurements. For example, the device or system can establish that the formation pressure is equal to the average pressure measurement value $P_{avg}$, of a first pressure measurement and a last pressure measurement, as shown below in Equation 3, wherein P1 is a first pressure measurement and P2 is a second pressure measurement:

$$\frac{P1+P2}{2}=P_{avg} \tag{3}$$

While the above discloses establishing an actual formation pressure as a mean average of two pressure measurements, the device or system can establish an actual formation pressure based on a mean, median, or other statistical function of two or more pressure measurements. Alternatively, or in addition, the formation property prediction can be for a correlated formation property such as mud weight, permeability, hydrocarbon in place, etc. For example, the device or system can first predict a formation pressure based on an asymptotic trend of a measurement pattern and then use the formation pressure prediction to generate a prediction of a mud weight. Once the system has generated one or more formation property predictions, operations of the flowchart 800 can be considered complete.

Example Computer

Figure 9:
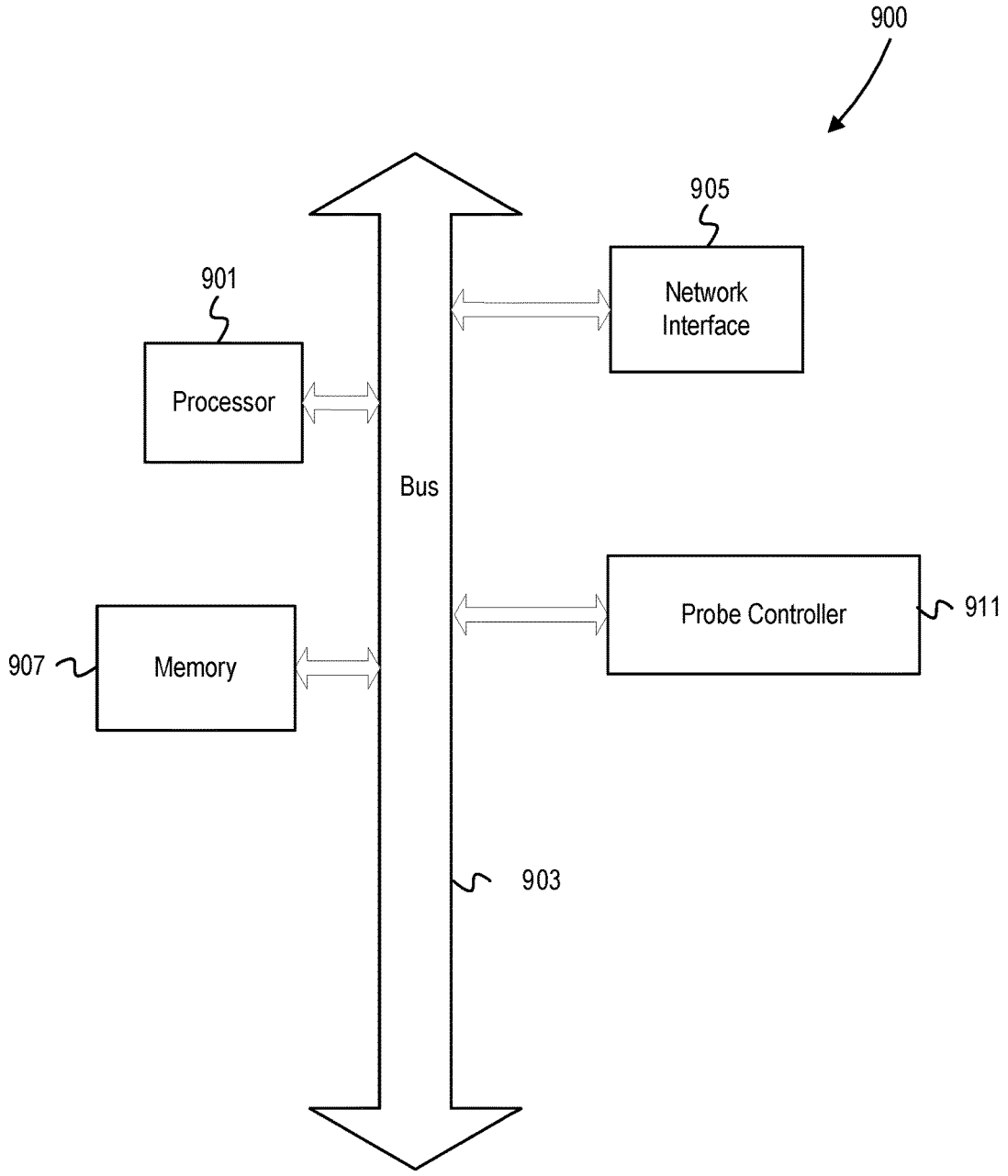
FIG. 9 is a schematic diagram of an example computer device.

FIG. 9 is a schematic diagram of an example computer device. A computer device 900 includes a processor 901 (possibly including multiple processors, multiple cores, multiple nodes, and/or implementing multi-threading, etc.). The computer device 900 includes a memory 907. The memory 907 may comprise system memory. Example system memory can include one or more of cache, static random access memory (RAM), dynamic RAM, zero capacitor RAM, Twin Transistor RAM, enhanced dynamic RAM, extended data output RAM, double data rate RAM, electrically erasable programmable read-only memory, nano RAM, resistive RAM, "silicon-oxide-nitride-oxide-silicon memory, parameter RAM, etc., and/or any one or more of the above already described possible realizations of machine-readable media. The computer device 900 also includes a bus 903. The bus 903 can include buses such as Peripheral Component Interconnect (PCI), Industry Standard Architecture (ISA), PCI-Express, HyperTransport® bus, InfiniBand® bus, NuBus, etc. The computer device 900 can also include a network interface 905 (e.g., a Fiber Channel interface, an Ethernet interface, an internet small computer system interface, synchronous optical networking interface, wireless interface, etc.).

The computer device 900 can include a measurement operations controller 911. The measurement operations controller 911 can perform one or more operations to control a pressure sensor and/or equipment attached to a pressure sensor as described above. For example, the measurement operations controller 911 can generate instructions to radially extend a pad. Additionally, the measurement operations controller 911 can acquire one or more pressure measurements. With respect to FIG. 1, FIG. 2, FIG. 3, and FIG. 4, the measurement operations controller 911 may be similar to or identical to any of the surface systems 110, 210, 310, or 410.

one of the previously described functionalities can be partially (or entirely) implemented in hardware and/or on the processor 901. For example, the functionality can be implemented with an application specific integrated circuit, in logic implemented in the processor 901, in a co-processor on a peripheral device or card, etc. Further, realizations can include fewer or additional components not illustrated in FIG. 9 (e.g., video cards, audio cards, additional network interfaces, peripheral devices, etc.). The processor 901 and the network interface 905 are coupled to the bus 903. Although illustrated as being coupled to the bus 903, the memory 907 can be coupled to the processor 901. Moreover, while the computer device 900 is depicted as a computer, some embodiments can be any type of device or apparatus to perform operations described herein.

As will be appreciated, aspects of the disclosure can be embodied as a system, method or program code/instructions stored in one or more machine-readable media. Accordingly, aspects can take the form of hardware, software (including firmware, resident software, micro-code, etc.), or a combination of software and hardware aspects that can all generally be referred to herein as a "circuit" or "system." The functionality presented as individual units in the example illustrations can be organized differently in accordance with any one of platform (operating system and/or hardware), application ecosystem, interfaces, programmer preferences, programming language, administrator preferences, etc.

Any combination of one or more machine readable medium(s) can be utilized. The machine-readable medium can be a machine-readable signal medium or a machine-readable storage medium. A machine-readable storage medium can be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium can be any tangible medium that can contain, or store a program for use by or in connection with an instruction execution system, apparatus, or device. A machine-readable storage medium is not a machine-readable signal medium.

A machine-readable signal medium can include a propagated data signal with machine readable program code embodied therein, for example, in baseband or as part of a carrier wave. Such a propagated signal can take any of a variety of forms, including, but not limited to, electromagnetic, optical, or any suitable combination thereof. A machine-readable signal medium can be any machine readable medium that is not a machine-readable storage medium and that can communicate, propagate, or transport a program for use by or in connection with an instruction execution system, apparatus, or device.

Program code embodied on a machine-readable medium can be transmitted using any appropriate medium, including but not limited to wireless, wireline, optical fiber cable, RF, etc., or any suitable combination of the foregoing.

Computer program code for carrying out operations for aspects of the disclosure can be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code can execute entirely on a stand-alone machine, can execute in a distributed manner across multiple machines, and can execute on one machine while providing results and or accepting input on another machine.

Terminology and Variations

The program code/instructions can also be stored in a machine-readable medium that can direct a machine to function in a particular manner, such that the instructions stored in the machine-readable medium produce an article of manufacture including instructions which implement the function/act specified in the flowchart and/or block diagram block or blocks.

Plural instances may be provided for components, operations or structures described herein as a single instance.

Finally, boundaries between various components, operations, and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed. A set of items can have only one item or more than one item. For example, a set of numbers can be used to describe a single number or multiple numbers. As used herein, a formation tester tool can be any tool or set of physically connected components that can be used to measure a property of a formation or a signal traveling through a formation.

Example Embodiments

Example embodiments include the following:

Embodiment 1: A method comprises forming a first sealed connection volume between a formation and a first pressure sensor in a borehole, forming a second sealed connection volume between the formation and a second pressure sensor in the borehole, wherein the second sealed connection volume surrounds the first sealed connection volume, lowering a pressure of the second sealed connection volume to be less than a borehole pressure, acquiring a first pressure measurement using the first pressure sensor, wherein the first pressure measurement is acquired before lowering the pressure of the second sealed connection volume, and wherein lowering the pressure comprises lowering the pressure to a first lowered outer volume pressure during a first interval, acquiring a second pressure measurement using the first pressure sensor during or after the first interval, and, in response to a determination that a measurement pattern shows a trend to a formation pressure value, generating a formation property prediction based on the second pressure measurement, wherein the measurement pattern is based on the second pressure measurement.

Embodiment 2: The method of Embodiment 1, further comprising increasing the pressure in the borehole.

Embodiment 3: The method of any of Embodiments 1-2, wherein lowering the pressure comprises lowering the pressure to a pressure value less than or equal to 75% of the borehole pressure.

Embodiment 4: The method of any of Embodiments 1-3, further comprising lowering the pressure of the second sealed connection volume during a second interval to a second lowered outer volume pressure, wherein the second lowered outer volume pressure is less than the first lowered outer volume pressure, and acquiring a third pressure measurement using the first pressure sensor during or after the second interval, wherein determining whether the measurement pattern shows the trend to the formation pressure value is based on the first pressure measurement, the second pressure measurement and the third pressure measurement.

Embodiment 5: The method of any of Embodiments 1-4, wherein generating the formation property prediction comprises establishing an average pressure measurement value as an actual formation pressure, wherein the average pressure measurement value is based on a series of pressure measurements comprising the first pressure measurement and the second pressure measurement.

Embodiment 6: The method of any of Embodiments 1-5, wherein determining whether the measurement pattern shows the trend to the formation pressure value comprising determining an asymptotic value based on the first pressure measurement and the second pressure measurement.

Embodiment 7: The method of any of Embodiments 1-6, wherein the method further comprises in response to a determination that the measurement pattern does not show the trend to the formation pressure value, perform a buildup operation, lower the pressure of the second sealed connection volume during an interval after the buildup operation, and acquire an additional pressure measurement using the first pressure sensor during or after the interval.

Embodiment 8: The method of any of Embodiments 1-7, wherein the formation property prediction comprises a mud weight.

Embodiment 9: An apparatus comprising a formation tester tool in a borehole within a formation, a first pressure sensor attached to the formation tester tool, a device to, form a first sealed connection volume between the formation and the first pressure sensor, form a second sealed connection volume between the formation and a second pressure sensor in the borehole, wherein the second sealed connection volume surrounds the first sealed connection volume, lower a pressure of the second sealed connection volume to be less than a borehole pressure, acquire a first pressure measurement using the first pressure sensor, wherein the first pressure measurement is acquired before lowering the pressure of the second sealed connection volume, and wherein lowering the pressure comprises lowering the pressure to a first lowered outer volume pressure during a first interval, acquire a second pressure measurement using the first pressure sensor during or after the first interval, and, in response to a determination that a measurement pattern shows a trend to a formation pressure value, generate a formation property prediction based on the second pressure measurement, wherein the measurement pattern is based on the second pressure measurement.

Embodiment 10: The apparatus of Embodiment 9, wherein the formation tester tool comprises a first pad, wherein the first pad is radially extendable with respect to an axis of the formation tester tool, and wherein the first pressure sensor is inside the first pad, and a second pad, wherein at least a portion of the first pad is inside of the second pad, and wherein the second pad is radially extendable with respect to the axis of the formation tester tool.

Embodiment 11: The apparatus of any of Embodiments 9-10, wherein the formation tester tool comprises a first pad, wherein the first pad is radially extendable with respect to an axis of the formation tester tool, and wherein the first pressure sensor is inside the first pad, a first radially extendable packer attached to the formation tester tool, wherein the first radially extendable packer is axially above the first pad with respect to the axis of the formation tester tool, and a second radially extendable packer attached to the formation tester tool, wherein the second radially extendable packer is axially below the first pad with respect to the axis of the formation tester tool.

Embodiment 12: The apparatus of any of Embodiments 9-11, wherein the formation tester tool comprises a first radially extendable packer attached to the formation tester tool, and a second radially extendable packer attached to the formation tester tool, wherein the second radially extendable packer is axially below the first radially extendable packer with respect to an axis of the formation tester tool, a first fluid extraction path that is exposed to a first volume between the first radially extendable packer and second radially extendable packer, a third radially extendable packer attached to the formation tester tool, wherein the third radially extendable packer is axially below the second radially extendable packer with respect to the axis of the formation tester tool, a second fluid extraction path that is exposed to a second volume between the second radially extendable packer and third radially extendable packer, wherein the second volume is at least a part of the second sealed connection volume, a fourth radially extendable packer attached to the formation tester tool, wherein the fourth radially extendable packer is axially below the third radially extendable packer with respect to the axis of the formation tester tool, and a third fluid extraction path that is exposed to a third volume between the third radially extendable packer and fourth radially extendable packer.

Embodiment 13: The apparatus of Embodiment 12, wherein the first pressure sensor is inside at least one of the second radially extendable packer and the third radially extendable packer.

Embodiment 13: The apparatus of any of Embodiments 12-13, wherein the formation tester tool comprises a pad, wherein the pad is radially extendable with respect to an axis of the formation tester tool, and wherein the first pressure sensor is inside the pad, and wherein the pad is within the second volume.

Embodiment 15: One or more non-transitory machine-readable media comprising program code for generating a formation property prediction, the program code to form a first sealed connection volume between a formation and a first pressure sensor, form a second sealed connection volume between the formation and a second pressure sensor in a borehole, wherein the second sealed connection volume surrounds the first sealed connection volume, lower a pressure of the second sealed connection volume to be less than a borehole pressure, acquire a first pressure measurement using the first pressure sensor, wherein the first pressure measurement is acquired before lowering the pressure of the second sealed connection volume, and wherein lowering the pressure comprises lowering the pressure to a first lowered outer volume pressure during a first interval, acquire a second pressure measurement using the first pressure sensor during or after the first interval, and, in response to a determination that a measurement pattern shows a trend to a formation pressure value, generate the formation property prediction based on the second pressure measurement, wherein the measurement pattern is based on the second pressure measurement.

Embodiment 16: The one or more non-transitory machine-readable media of Embodiment 15, further comprising program code to lower the pressure of the second sealed connection volume during a second interval to a second lowered outer volume pressure, wherein the second lowered outer volume pressure is less than the first lowered outer volume pressure, and acquire a third pressure measurement using the first pressure sensor during or after the second interval, wherein determining whether the measurement pattern shows the trend to the formation pressure value is based on the first pressure measurement, the second pressure measurement and the third pressure measurement.

Embodiment 17: The one or more non-transitory machine-readable media of any of Embodiments 15-16, further comprising program code to establish an average pressure measurement value as an actual formation pressure, wherein the average pressure measurement value is based on the the first pressure measurement and the second pressure measurement.

Embodiment 18: The one or more non-transitory machine-readable media of any of Embodiments 15-17, wherein determining whether the measurement pattern shows the trend to the formation pressure value comprising determining an asymptotic value based on the first pressure measurement and the second pressure measurement.

Embodiment 19: The one or more non-transitory machine-readable media of any of Embodiments 15-18, further comprising program code to, in response to a determination that the measurement pattern does not show the trend to the formation pressure value, perform a buildup operation, lower the pressure of the second sealed connection volume during an interval after performing the buildup operation, and acquire an additional pressure measurement using the first pressure sensor during or after the interval.

Embodiment 20: The one or more non-transitory machine-readable media of any of Embodiments 15-19, wherein the formation property prediction comprises a mud weight.

What is claimed is:

1. An apparatus comprising:

a formation tester tool to be positioned in a borehole within a formation, wherein the formation tester tool comprises, a pressure sensor;

a first radially extendable inner packer;

a second radially extendable outer packer that is axially above the first radially extendable inner packer with respect to an axis of the formation tester tool;

a third radially extendable inner packer that is axially below the first radially extendable inner packer with respect to the axis of the formation tester tool; and a fourth radially extendable outer packer that is axially below the third radially extendable inner packer with respect to the axis of the formation tester tool; and a device configured to, cause the first radially extendable inner packer, the second radially extendable outer packer, the third radially extendable inner packer, and the fourth radially extendable outer packer to expand from the formation tester tool outward to the formation to form a sealed volume that is isolated from other regions of the borehole;

form a sealed connection volume between the formation and the pressure sensor;

control iterative drawdown tests on the sealed volume to determine a formation pressure estimate, wherein the iterative drawdown tests are to lower, in a first iteration, a pressure of the sealed volume to be within a first pressure range based on a borehole pressure and an initial measurement of a pressure of the sealed connection volume, and lower, in one or more later iterations, the pressure of the sealed volume to be within a second pressure range based on the pressure of the sealed connection volume at a preceding iteration; and in response to a determination that the pressures of the sealed volume during the iterative drawdown tests show a trend in a formation pressure value, generate a formation property prediction based on the trend.

2. The apparatus of claim 1, wherein the device is further configured to, extract fluid from the sealed volume to reduce a pressure around the pressure sensor.

3. The apparatus of claim 2, wherein the device is configured to extract the fluid from the sealed volume to reduce the pressure around the pressure sensor to a pressure value that is less than or equal to 75% of the borehole pressure.

4. The apparatus of claim 2, wherein the device includes a fluid extraction path to extract the fluid from the sealed volume and into the formation tester tool.

5. The apparatus of claim 2, wherein the device is further configured to, perform a buildup operation;

perform a drawdown operation, and extract additional fluid from the sealed volume to further reduce the pressure around the pressure sensor; and acquire, via the pressure sensor, at least one additional pressure measurement from fluids in the sealed connection volume.

6. The apparatus of claim 1, wherein the device configured to generate the formation property prediction comprises the device configured to establish an average pressure measurement value as an actual formation pressure.

7. The apparatus of claim 6, wherein the average pressure measurement value is based on a series of pressure measurements made during the iterative drawdown tests.

8. The apparatus of claim 1, wherein the formation property prediction comprises a prediction of a mud weight.

9. A method comprising:

positioning a formation tester tool into a borehole formed within a formation;

radially expanding a first radially extendable inner packer, a second radially extendable outer packer, a third radially extendable inner packer, and a fourth radially extendable outer packer of the formation tester tool out from the formation tester tool to the formation to form a sealed volume between the first radially extendable inner packer and the third radially extendable inner packer and to form a sealed connection volume between the formation and a pressure sensor of the formation tester tool;

iteratively performing drawdown tests on the sealed volume to determine a formation pressure estimate, the iterative drawdown tests including lowering, in a first iteration, a pressure of the sealed volume to be within a first pressure range based on a borehole pressure and an initial measurement of a pressure of the sealed connection volume, and lowering, in one or more later iterations, the pressure of the sealed volume to be within a second pressure range based on the pressure of the sealed connection volume at a preceding iteration; and in response to a determination that the pressures of the sealed volume during the iterative drawdown tests shows a trend in a formation pressure value, generating a formation property prediction based on the trend.

10. The method of claim 9, further comprising increasing the borehole pressure.

11. The method of claim 9, further comprising extracting fluid from the sealed volume to reduce a pressure around the pressure sensor to a pressure value less than or equal to 75% of the borehole pressure.

12. The method of claim 9, wherein generating the formation property prediction comprises establishing an average pressure measurement value as an actual formation pressure.

13. The method of claim 12, wherein the average pressure measurement value is based on a series of pressure measurements made during the iterative drawdown tests.

14. The method of claim 9, further comprising extracting fluid from the sealed volume via a fluid extraction path to extract the fluid from the sealed volume and into the formation tester tool.

15. The method of claim 9, further comprising, performing a buildup operation;

performing a drawdown operation, and extracting fluid from the sealed volume to reduce a pressure around the pressure sensor; and acquiring, via the pressure sensor, at least one additional pressure measurement, from fluids in the sealed connection volume.

16. The method of claim 9, wherein the formation property prediction comprises a prediction of a mud weight.

17. A non-transitory, computer-readable medium having instructions stored thereon that are executable by a processor, the instructions comprising:

instructions to radially expand a first radially extendable inner packer, a second radially extendable outer packer, a third radially extendable inner packer, and a fourth radially extendable outer packer of a formation tester tool out from the formation tester tool to a formation to form a sealed volume between the first radially extendable inner packer and the third radially extendable inner packer and to form a sealed connection volume between the formation and a pressure sensor of the formation tester tool;

instructions to iteratively perform drawdown tests on the sealed volume to determine a formation pressure estimate, the instructions to iteratively perform drawdown tests including instructions to lower, in a first iteration, a pressure of the sealed volume to be within a first pressure range based on a borehole pressure and an initial measurement of a pressure of the sealed connection volume, and instructions to lower, in one or more later iterations, the pressure of the sealed volume to be within a second pressure range based on the pressure of the sealed connection volume at a preceding iteration; and instructions to, in response to a determination that the pressures of the sealed volume during the iterative drawdown tests shows a trend in a formation pressure value, generate a formation property prediction based on the trend.

18. The non-transitory, computer-readable medium of claim 17, further comprising instructions to extract fluid from the sealed volume to reduce a pressure around the pressure sensor to a pressure value less than or equal to 75% of the borehole pressure.

19. The non-transitory, computer-readable medium of claim 17, wherein the instructions to generate the formation property prediction comprises instructions to establish an average pressure measurement value as an actual formation pressure.

20. The non-transitory, computer-readable medium of claim 19, wherein the average pressure measurement value is based on a series of pressure measurements made during the iterative drawdown tests.

21. The non-transitory, computer-readable medium of claim 17, further comprising, instructions to perform a buildup operation;

instructions to perform a drawdown operation, and extract fluid from the sealed volume to reduce a pressure around the pressure sensor; and instructions to acquire, via the pressure sensor, at least one additional pressure measurement, from fluids in the sealed connection volume.

* * * * *